US011136180B2

(12) United States Patent
Swails et al.

(10) Patent No.: US 11,136,180 B2
(45) Date of Patent: Oct. 5, 2021

(54) PAPER PRODUCT DISPENSING SYSTEM

(71) Applicant: Kimberly-Clark Worldwide, Inc., Neenah, WI (US)

(72) Inventors: Marvin E. Swails, Alpharetta, GA (US); David A. Lilley, Duluth, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/344,286

(22) PCT Filed: Oct. 31, 2017

(86) PCT No.: PCT/US2017/059398
§ 371 (c)(1),
(2) Date: Apr. 23, 2019

(87) PCT Pub. No.: WO2018/081828
PCT Pub. Date: May 3, 2018

(65) Prior Publication Data

US 2019/0270575 A1 Sep. 5, 2019

Related U.S. Application Data

(60) Provisional application No. 62/415,027, filed on Oct. 31, 2016.

(51) Int. Cl.

| | |
|---|---|
| ***B65D 83/08*** | (2006.01) |
| ***A47K 10/42*** | (2006.01) |
| *A47K 10/32* | (2006.01) |

(52) U.S. Cl.
CPC ..... *B65D 83/08* (2013.01); *A47K 10/42* (2013.01); *A47K 10/424* (2013.01); *A47K 2010/3233* (2013.01)

(58) Field of Classification Search
CPC ..... A47K 2010/428; A47K 10/421; A47K 10/424
USPC ..... 221/33–63, 241
See application file for complete search history.

(56) References Cited

U.S. PATENT DOCUMENTS

| | | | | |
|---|---|---|---|---|
| 1,658,085 A * | 2/1928 | Hudson | B65D 83/0894 | 206/494 |
| 1,874,642 A * | 8/1932 | Shaffer | A47K 10/427 | 221/35 |
| 2,823,089 A * | 2/1958 | De Franco | B65D 83/0894 | 221/47 |
| 2,923,435 A * | 2/1960 | Chaplin | A47K 10/16 | 206/449 |

(Continued)

FOREIGN PATENT DOCUMENTS

| | | |
|---|---|---|
| CN | 105744869 A | 7/2016 |
| EP | 0498399 B1 | 4/1995 |
| WO | 03037746 A3 | 10/2003 |

*Primary Examiner* — Timothy R Waggoner

(57) ABSTRACT

A consumable product dispenser comprising: a housing comprising a front cover, a back, two sides, a product holding area defined by the front cover, back and two sides, and a dispenser opening defining an opening in the housing to the product holding area; and wherein the front cover, the back, and two sides are arranged to form a non-rectangular and noncircular cross section for the product holding area in an X-Y plane.

8 Claims, 4 Drawing Sheets

(56) References Cited

U.S. PATENT DOCUMENTS

| | | | | |
|---|---|---|---|---|
| 5,007,558 | A * | 4/1991 | Allen | A47K 10/421 221/24 |
| 6,202,889 | B1 | 3/2001 | Veith | |
| 8,910,827 | B2 * | 12/2014 | Lockwood | A47F 1/126 221/14 |
| 2003/0178336 | A1 | 9/2003 | Zomorodi et al. | |
| 2004/0084471 | A1 | 5/2004 | Taylor et al. | |
| 2008/0135571 | A1 | 6/2008 | Long et al. | |

* cited by examiner

PAPER PRODUCT DISPENSING SYSTEM

This application claims priority from U.S. provisional Patent Application Ser. No. 62/415027 filed on Oct. 31, 2016, the entire contents of which are incorporated herein by reference.

This disclosure generally relates to a consumable product dispensing system.

BACKGROUND

Systems dispensing consumable products are ubiquitous in many environments today. For example, consumable product dispensers, e.g., hand towel and facial tissue, are commonplace in many private, semi-private and public washrooms and break rooms. Given this widespread adoption, it's desirable to ensure the consumable products correctly and consistently dispense. Improper dispensing can occur, for example, when product not designed for use with a given dispenser is stocked in that dispenser, which can result in suboptimal or no dispensing.

SUMMARY

In general, the subject matter of this specification relates to a paper product dispenser for paper products such as, for example, folded paper products. One aspect of the subject matter described in this specification can be implemented in systems that include a housing comprising a front, a back, two sides, a product holding area defined by the front, back and two sides, and a dispenser opening defining an opening in the housing to the product holding area; and where the front, the back, and two sides are arranged to form a non-rectangular and non-circular cross section for the product holding area in an X-Y plane. Other embodiments of this aspect include corresponding apparatus and methods.

Yet another aspect of the subject matter described in this specification can be implemented in a method including opening a dispenser to gain access to a product holding area in the dispenser, wherein the product holding area has a non-rectangular, non-circular, horizontal cross section; and adding consumable product in the product holding area, wherein the consumable product has a shape matched to the cross section. Other embodiments of this aspect include corresponding apparatus and systems.

Yet another aspect of the subject matter described in this specification can be implemented in a method including fitting one or more perimeter inserts into a product holding area of a product dispenser, where the product holding area (i) is configured to hold consumable product and (ii) has a first cross-sectional shape in an X-Y plane with a perimeter, and where the perimeter inserts are positioned proximate to the perimeter and change the first cross-sectional shape to a non-rectangular and non-circular cross-section. Other embodiments of this aspect include corresponding apparatus and systems.

In some implementations, the systems, apparatuses and methods described herein have one or a combination of the following features. The cross section is a trapezoidal cross section and the product are folded paper hand towels, facial tissues or wipers. The X-Y plane of the cross section is normal to a vertical axis. The product is stacked in the product holding area along the vertical axis. The opening in the housing to the product holding area is in a top side of the housing in some implementations and the bottom side in others.

Particular embodiments of the subject matter described in this specification can be implemented so as to realize one or more of the following advantages. For example, the dispenser has a non-standard cross section matched to the paper product shape, which helps prevent the use of unauthorized product, which may not dispense correctly through the dispenser causing dispensing errors and/or jams that affect the operability of the dispenser, as dispensers are typically designed to operate with paper product having certain size, shape, basis weight and bulk characteristics.

Having, for example, a trapezoidal or other non-rectangular shape can also reduce the area of the paper product, as compared with rectangular-shaped sheets. This in turn can reduce waste as users tend to grab multiple sheets for drying, whether necessary or not, with little regard to the precise surface area of the sheet. Thus providing a sheet with, for example, a 10-20% area reduction will likely not cause a user to grab an extra sheet but will reduce the waste as less product is used to dry the user's hands.

The details of one or more implementations of the subject matter described in this specification are set forth in the accompanying drawings and the description below. Other features, aspects, and advantages of the subject matter will become apparent from the description, the drawings, and the claims.

DESCRIPTION OF DRAWINGS

Like reference symbols in the various drawings indicate like elements.

DETAILED DESCRIPTION

The present disclosure generally relates to a paper product dispenser.

More specifically, the dispenser includes a housing (e.g., external shell or case) and a product holding area within the housing. The product holding area defines a space to hold paper product, e.g., folded towels in a vertical stack, to be dispensed to a user. The shape of the towels and cross section of the product holding are matched to be the same shape and size, and that shape is non-rectangular or non-rectangular and non-circular. For example, the shape can be a trapezoid or a non-rectangular parallelogram. The dispenser is described in more detail below with reference to FIGS. 1A, 1B and 1C.

Figure 1A:
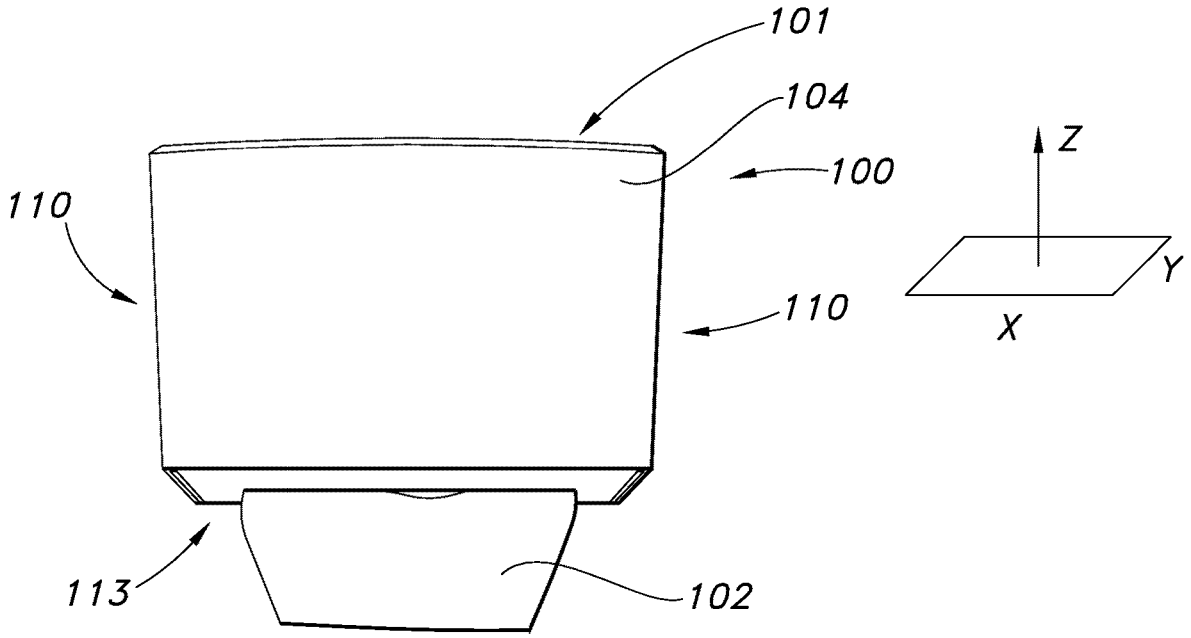
FIG. 1A is a representation of an example product dispenser with the front cover in a closed position.
Figure 1B:
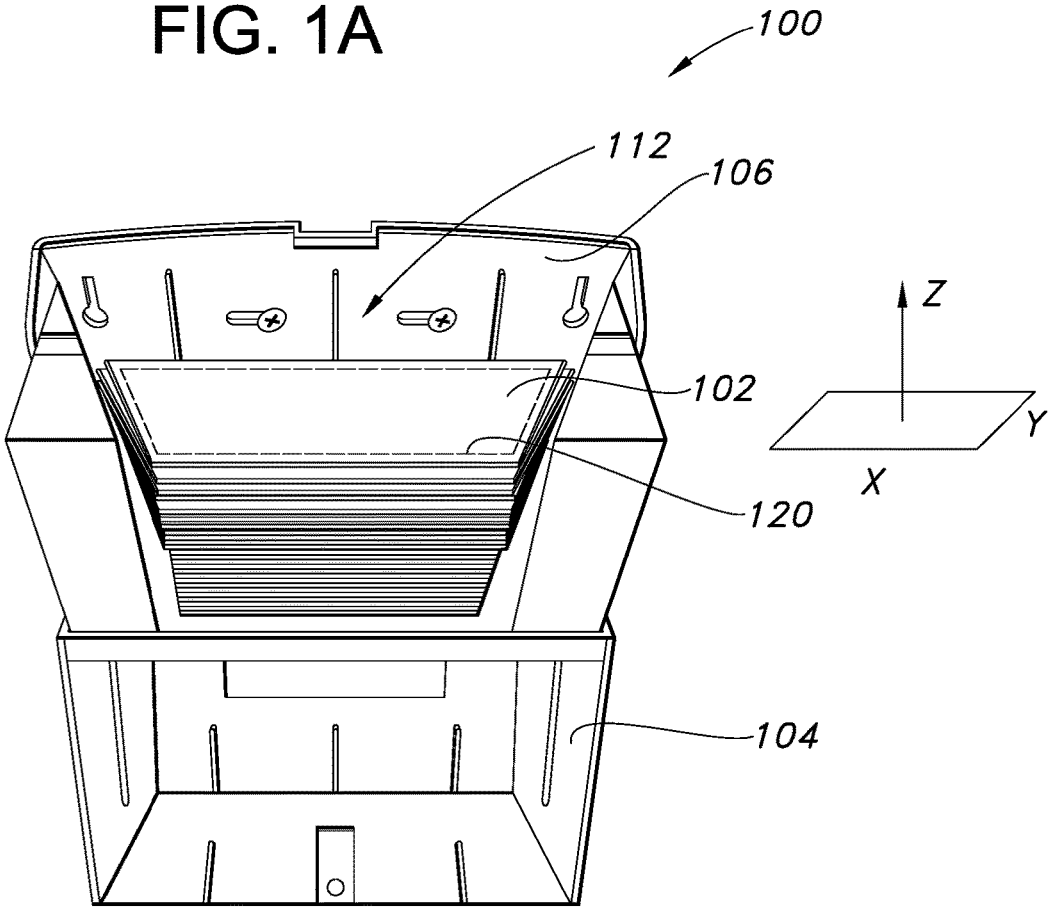
FIG. 1B is a representation of an example product dispenser with the front cover in an open position.
Figure 1C:
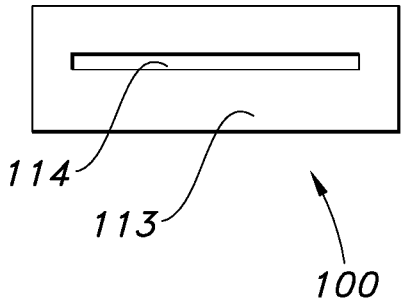
FIG. 1C is a view of the bottom portion of the example dispenser with the front cover in the closed position.

FIG. 1A is a representation of an example product dispenser 100 with the front cover 104 in a closed position, FIG. 1B is a representation of an example product dispenser 100 with the front cover 104 in an open position, and FIG. 1C is a view of the bottom portion 113 of the dispenser 100 with the front cover 104 in the closed position. The dispenser 100 can be, for example, a folded hand towel dispenser 100, a facial tissue dispenser 100, a wiper/wipe dispenser 100 or the like for stacked paper products 102. Paper products 102 describes sheet material made from, for example, cellulose fibers (e.g., wood pulp), synthetic fibers (e.g., polypropylene) or some combination thereof, and include, for example, face tissue, wipes/wipers and paper towels. Stacked products describes the arrangement of paper products in top side-to-bottom side configuration for sheet-by-sheet dispensing.

In some implementations, the paper products 102 are folded such as in a quarter fold arrangement where a portion of one paper product is folded into the next in the stack such that when a paper product 102 is dispensed it pulls the next paper product 102 partially through the dispenser opening 114 for easy access by a user for the next dispense.

The dispenser 100 includes a front cover 104, a back 106, two sides 110, a product holding area 112 defined by the front cover 104 (when closed), back 106 and two sides 110 (and the top and bottom 113 portions of the housing 101). In some implementations, the product holding area 112 is the interior region (e.g., open area to hold product 102) of the housing 101. In some implementations, the front cover 104 (and optionally the bottom portion 113 of the housing 101) are pivotally connected to the back 106 at the bottom of the front cover 104 (or optionally at the bottom portion 113 of the housing 101) such that the front cover 104 (and optionally the bottom portion 113) can swing down to expose the product holding area 112 to access the paper product 102, e.g., for refilling the dispenser 100 with additional paper product 102.

The dispenser 100 also includes a dispenser opening 114 defining an opening in the housing 101 to the product holding area 112. The dispenser opening 114 allows the sheets to pass from the product holding area 112 through the housing 101 for dispensing to a user. In some implementations, the dispenser opening 114 is a slot (or other orifice) in the bottom 113 of the housing 101 or in the lower portion of the front cover 104. In some implementations, the dispenser opening 114 can be at a top portion of the housing 101 opposite the bottom portion 113, or in a side 110 of the housing 101. For example, the dispenser 100, for the dispenser opening 114 in the top portion of sides 110, may include a spring (or other biasing member) that pushes the stack of paper product towards the opening 114.

Figure 1D:
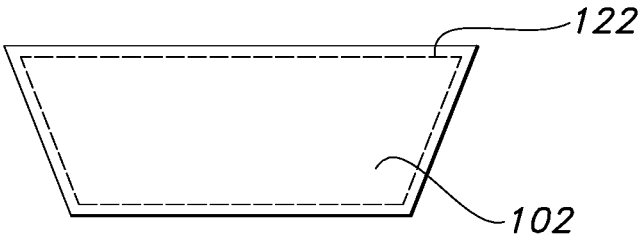
FIG. 1D is a representation of an example paper product in a folded configuration.

The front cover 104, the back 106, and two sides 110 are arranged to form a non-rectangular and non-circular cross section for the product holding area 114 in an X-Y plane, as shown by the dotted lines 120 in FIG. 1B. The shape of the paper product 102 is set to match the cross section 120 of the product holding area 114. As used in this specification, "match" means to have the cross section 120 of the product holding area 114 and the shape of the paper product 102 correspond such (i) the shape of the paper product 122 (as shown by the dotted lines in FIG. 1D) does not need to be distorted or reshaped to rest in the product holding area 114 and/or (ii) dispenses as designed (e.g., according to specifications) from the dispenser 100 by the dispenser manufacturer. In some implementations, matching additionally means the paper product 102 occupies greater than 80% (and preferably 90%) of the cross section of the product holding area 114.

Figure 1E:
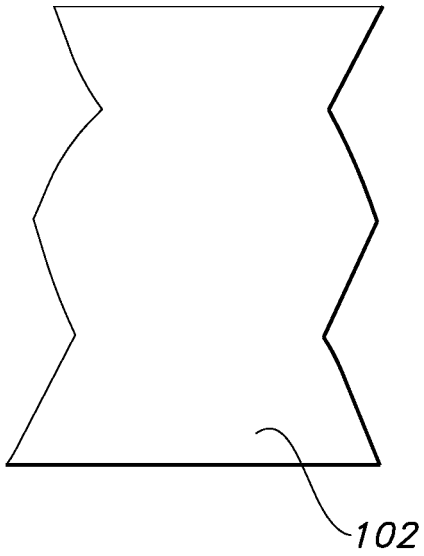
FIG. 1E is a representation of an example paper product in unfolded configurations.

In some implementations, the cross section 120 is a trapezoidal shape and the paper product are folded hand towels stacked along a vertical axis (Z) normal to the X-Y plane. Such folded hand towels from FIG. 1D, for example, can be unfolded as shown in FIG. 1E.

Figure 2:
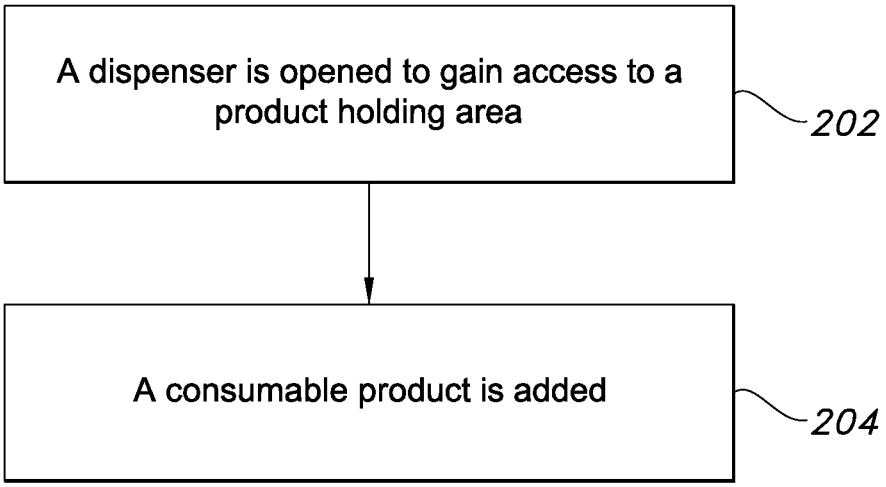
FIG. 2 is an example process for refilling a dispenser.

FIG. 2 is an example process 200 for refilling a dispenser 100. A dispenser is opened to gain access to a product holding area in the dispenser (202). For example, the dispenser 100 is opened by (optionally, releasing a latch holding the front cover 104 to the back 106 and) pivoting the front cover 104 down to reveal the product holding area 114, resulting in the configuration shown in FIG. 1B.

The product holding area 114 has a non-rectangular, non-circular, horizontal cross section 120 such as, for example, a trapezoidal shape. In some implementations, the cross section 120 can take the shape of a non-rectangular parallelogram. Non-rectangular describes any shape that is not a parallelogram with four right angles. In some implementations the cross section 120 has a rectangular shape but has one or more wavy or irregularly shaped sides.

A consumable product is added in the product holding area (204). The consumable product has a shape matched to the cross section. For example, the folded paper hand towels 102 in a stacked arrangement are added to the product holding area 114. As shown in FIG. 1B, for some implementations, the cross section 120 and shape of the paper product 122 are both trapezoidal. The font cover 104 can then be closed to allow for normal dispensing from the dispenser 100, for example, a user pulling a paper product 102, e.g., one at a time, from the opening 114 at the bottom 113 of the dispenser 100.

Figure 3:
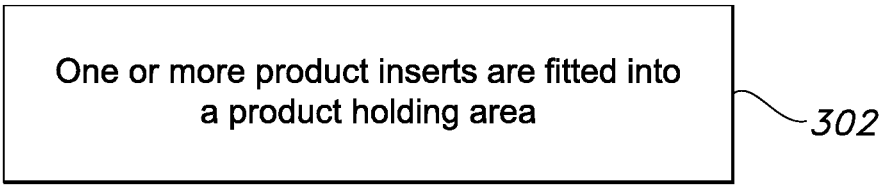
FIG. 3 is an example process for retrofitting a dispenser.

Many consumable product dispensers have a product holding area with a rectangular cross section. In some scenarios these types of dispensers can be retro-fit with inserts to accommodate non-rectangular cross sections, as described with respect to FIG. 3, which is an example process 300 for retrofitting a dispenser 100.

Figure 4A:
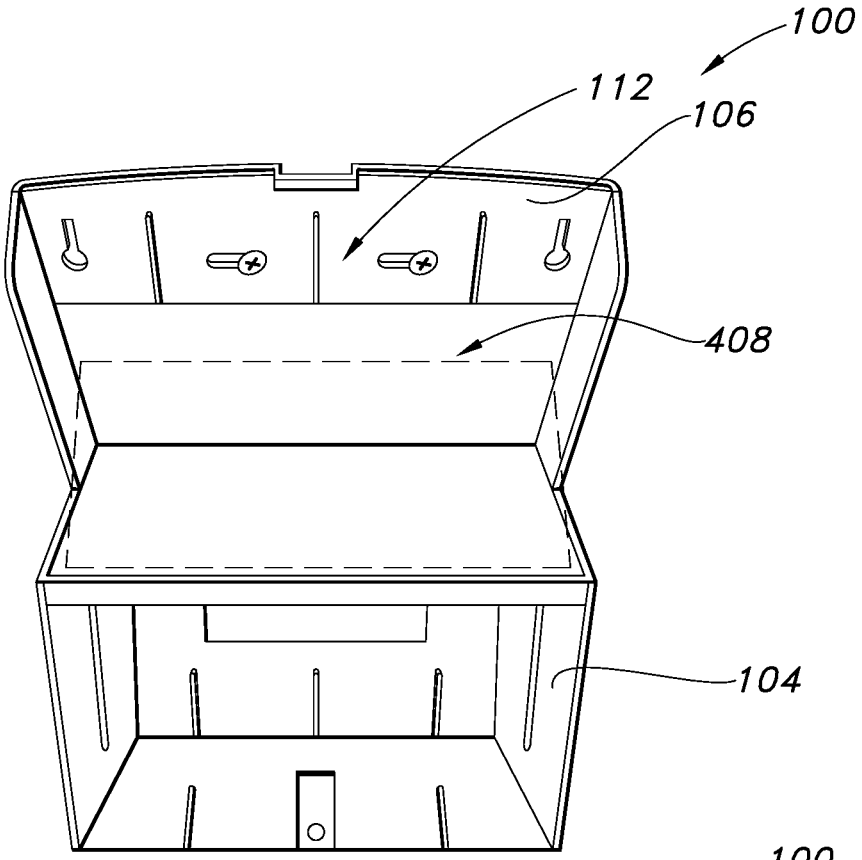
FIG. 4A is a representation of an example dispenser with a product holding area having a rectangular cross section.
Figure 4B:
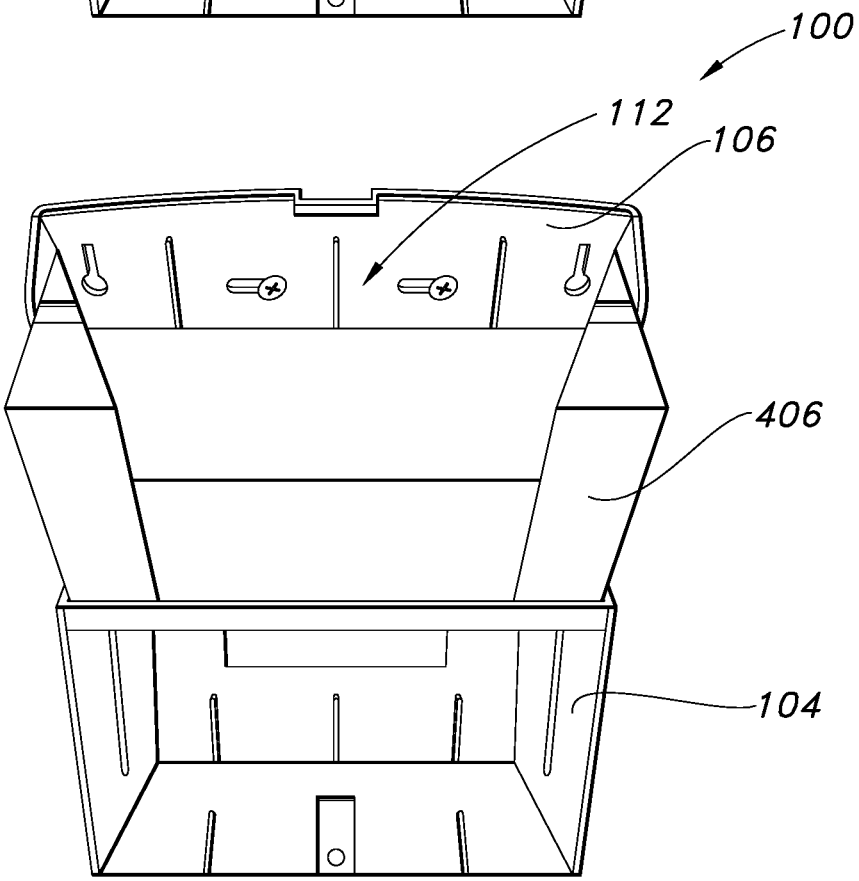
FIG. 4B is a representation of an example dispenser with the product holding area with perimeter inserts.

One or more perimeter inserts are fitted into a product holding area of a product dispenser (302). In some implementations, the product holding area 114 (i) is configured to hold consumable product and (ii) has a first cross-sectional shape in an X-Y plane with a perimeter, and where the perimeter inserts are positioned proximate to the perimeter and change the first cross-sectional shape to a non-rectangular and non-circular cross-section. FIG. 4A and 4B, respectively, are a representation of an example product dispenser with a rectangular cross section and is a representation of the example product dispenser of FIG. 4A with inserts to change the cross section to non-rectangular and non-circular shape.

FIG. 4A shows a dispenser 100 with a product holding area 112 having a rectangular cross section. FIG. 4B shows the dispenser 100 with the product holding area 112 with perimeter inserts 406 (e.g., triangular shaped in this example) inserted, up against the sides of the perimeter 408 of the product holding area 112, which turns the cross section of the product holding area 112 into a trapezoidal shape. In this way the cross section of a dispenser 100 can be changed to accommodate different shaped paper product 102. In some implementations the insert(s) 406 can have different shapes (to change the cross section of the product holding area 112 to match the shape of the paper product 102) and be placed on one side, both sides, the back, the front, all or some combination thereof.

In some implementations, the inserts 406 run the entire vertical height of the product holding area 112 or the height of the product holding area 112 to which paper product 102 are stacked. The inserts 406 can be, for example, composed of foam, plastic, a composite, metals, or the like. The inserts 406 are held in place in the product holding area 406 by, for example, the presence of the paper product 102, mechanical attachment such as screws, and/or adhesives such as double sided tape.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

This written description does not limit the invention to the precise terms set forth. Thus, while the invention has been described in detail with reference to the examples set forth above, those of ordinary skill in the art may effect alterations, modifications and variations to the examples without departing from the scope of the invention.

What is claimed is:

1. A method comprising:

providing a product dispenser configured to hold a first consumable product in a product holding area of the product dispenser, wherein the first consumable product has a rectangular shape and the product holding area has a first cross-sectional shape in an X-Y plane with a perimeter, and wherein the first cross-sectional shape of the product holding area is rectangular and matched to the first shape of the consumable product;

fitting one or more perimeter inserts into the product holding area of the product dispenser, wherein the perimeter inserts are positioned proximate to the perimeter and change the first cross-sectional shape of the product holding area to a second cross-sectional shape wherein the second cross-sectional shape is non-rectangular and non-circular cross-section, wherein the product holding area with the non-rectangular and non-circular cross-section is configured to hold a second consumable product having a non-rectangular and non-circular cross-section, and wherein the shape of the non-rectangular and non-circular cross-section of the product holding area with the permiter inserts is matched to that of the second consumable product.

2. The method of claim 1, wherein the consumable product are folded paper hand towels.

3. The method of claim 1, wherein the non-rectangular and non-circular cross-section is a trapezoidal cross-section.

4. The method of claim 1, wherein the consumable product is stacked in the product holding area along an axis normal to the X-Y plane.

5. The method of claim 1, wherein the product are facial tissues.

6. The method of claim 1, wherein the opening is in a top side of the housing.

7. The method of claim 1, wherein the opening is in a bottom side of the housing.

8. The method of claim 1, wherein the product are wipers.

* * * * *